United States Patent [19]

Hoppe et al.

[11] 4,285,898

[45] Aug. 25, 1981

[54] PROCESS FOR THE MANUFACTURE OF MONOFILAMENTS

[75] Inventors: Hans-Joachim Hoppe, Obernburg; Karl Ostertag, Erlenbach, both of Fed. Rep. of Germany

[73] Assignee: Akzona Incorporated, Asheville, N.C.

[21] Appl. No.: 77,839

[22] Filed: Sep. 21, 1979

[30] Foreign Application Priority Data

Sep. 21, 1978 [DE] Fed. Rep. of Germany ..... 2840988

[51] Int. Cl.[3] ..... D01D 5/00

[52] U.S. Cl. ..... 264/176 F; 28/290; 264/210.8

[58] Field of Search ..... 264/210.3, 210.8, 176 F, 264/168; 28/290

[56] References Cited

U.S. PATENT DOCUMENTS

| | | | |
|---|---|---|---|
| 2,324,397 | 7/1943 | Hull | 264/178 F |
| 2,888,711 | 6/1959 | Finlayson et al. | 264/176 F |
| 3,436,792 | 4/1969 | Hench | 264/176 F |
| 3,645,085 | 2/1972 | Rassart | 264/168 |
| 3,677,481 | 7/1972 | Haley et al. | 425/72 S |
| 3,715,419 | 2/1973 | Privott et al. | 264/82 |
| 4,017,580 | 4/1977 | Barbey | 425/66 |
| 4,035,879 | 7/1977 | Schippers | 28/246 |
| 4,049,763 | 9/1977 | Mineo et al. | 264/176F |
| 4,093,147 | 6/1978 | Bromley et al. | 264/176 F |
| 4,095,312 | 6/1978 | Haley | 264/210.8 |
| 4,133,620 | 1/1979 | Lehner | 264/176 F |
| 4,193,961 | 3/1980 | Roberts | 264/176 F |

FOREIGN PATENT DOCUMENTS

| | | | |
|---|---|---|---|
| 1760467 | 6/1972 | Fed. Rep. of Germany . | |
| 2638662 | 2/1978 | Fed. Rep. of Germany . | |
| 49-1249 | 1/1974 | Japan | 264/178 F |
| 51-75111 | 6/1976 | Japan | 28/271 |

*Primary Examiner*—Jay H. Woo

*Attorney, Agent, or Firm*—Francis W. Young; Tom R. Vestal

[57] ABSTRACT

The invention relates to a process for the manufacture of monofilaments for melt-spun synthetic polymers at high speeds. Lower spinning heights than conventional spinning applications are obtained by using the phenomena of natural yarn deflection.

8 Claims, 5 Drawing Figures

PROCESS FOR THE MANUFACTURE OF MONOFILAMENTS

The invention relates to a process for the manufacture of monofilaments from melt-spun synthetic polymers.

The term "monofilament" according to the invention refers to continuous filaments of an individual filament denier of about 20 dtex and upwards, corresponding to a diameter—depending upon the polymer—of about 0.05 mm. upwards. The so-called "fine monofilaments" have an individual filament denier of max. about 100 dtex; "heavy monofilaments" a denier of about 100 dtex to about 10,000 dtex (about 0.1 to 1.0 mm. diameter) or more. The monofilaments may have a circular cross section or a different profile, for instance, they may be flat ribbons of rectangular cross section.

Monofilaments of melt-spun synthetic polymers are normally obtained by spinning the melt in a cooling bath, followed by drawing of the freshly spun monofilaments in one or more stages. Spinning speeds are normally of the order of a few hundred mpm, and also, the drawing speeds only infrequently exceed this range. The growing danger of undesirable vacuole formation (cf. DE Pat. No. 1,760,467), and especially the virtually impossible further extension in practice of the cooling zone for the freshly extruded structures, stand in the way of an increase in spinning speed.

The objective of the invention is to make available a process for the manufacture of melt-spun monofilaments of synthetic polymers without the obligatory cooling bath, which, in spite of much higher working speeds, makes lower spinning heights (distance spinnaret./.draw-off unit) possible. Finally, depending on the textile-technological properties (strength, breaking elongation, shrinkage) dictated by the end-uses of the monofilament, post-drawing should no longer be required.

With this process, the objective is met according to the invention in that the freshly spun monofilaments are cooled in a gaseous atmosphere and drawn off at speeds of at least 2750 mpm. Surprisingly, at these draw-off speeds—known in the manufacture of textile multifilament yarns—high quality monofilaments having a diameter up to 1.0 mm and more can be obtained.

The gaseous atmosphere is preferably composed of air, in particular air moving transversally to the monofilaments.

The draw-off speeds range preferably between 5000 and 7000 mpm, specifically between 5200 and 6000 mpm. Polyester and polyamide monofilaments of a filament denier of about 50 to 1200 dtex can be obtained in these velocity ranges without post-drawing of the monofilaments.

In a preferred version of the process of the invention, the spinning height is kept low by taking advantage of the phenomenon of natural yarn deflection.

This phenomenon of "natural yarn deflection" is generally observed in melt spinning synthetic polymer filaments at a greater or lesser distance from the spinneret, when the draw-off unit is laterally displaced from its location which is normally essentially vertically below the spinneret. This can be clearly shown when e.g., drawing off polyester monofilament of 100 dtex end denier at a speed of 3750 mpm by gradually displacing the draw-off unit (high speed winder or yarn injector), initially located vertically below the spinneret, in a horizontal direction while—under certain conditions—simultaneously raising it in a vertical direction. Notwithstanding the resulting modified position of the draw-off unit, the filament below the spinneret continues to travel for a certain distance vertically downward and then deflects in the direction of the draw-off unit. The area of said "natural" yarn deflection, i.e., obtained without additional mechanical thread guiding elements extends merely over a few centimeters and does not essentially change position, even when the location of the draw-off unit is significantly modified. Conversely, the location of the "natural yarn deflection " can be varied by modification of the spinning conditions; for instance, when increasing the melt throughput, it is shifted farther away from the spinneret.

By means of this phenomenon, the spinning height (distance spinning height./.draw-off unit) can be "kept low", i.e., at the existing spinning room height the polymer throughput per spinneret orifice can be increased by lateral displacement of the draw-off unit and by taking advantage of the natural yarn deflection, or else at unchanged polymer throughput lower spinning room heights can be used. Expressed more generally, by means of the phenomenon of natural yarn deflection, high polymer throughputs are possible without having to provide for excessively dimensioned cooling zones which are unfeasible in practice.

It has already been suggested in West German patent disclosure No. 2,638,662 that melt-spun filaments be drawn-off laterally immediately at the lower end of the blow box and fed upward at an angle to a take-up unit, which could, e.g., be located next to the extruder. However, yarn deflection accomplished by means of a draw-off godet requires recrystallization of the filaments in the blow box to insure that the filaments are no longer tacky and have been stabilized to the point that they can be subjected to mechanical manipulation.

In contrast to said known proposal, use is made according to the invention of the phenomenon of natural yarn deflection, which takes place much nearer the spinneret in a zone where the filament cannot yet be mechanically manipulated. In this zone, polymer filament has a temperature of about 150° C. and a degree of crystallization of less than 10%. Attempts at mechanical deflection of the filament in this zone result immediately in spinning breaks due to the filament sticking to the thread deflecting element.

Compared to the known proposal, the preferred teaching of the invention makes it possible to use the phenomenon of natural yarn deflection to achieve a not insubstantial further reduction of the spinning height.

When making use of the phenomenon of natural yarn deflection, it has, furthermore, been noted that behind the area of natural yarn deflection, there is a zone in which crystallinity and birefringence of the monofilament increase perceptibly. A distinct post-drawing of the monofilaments by a factor of about 2 to 3 takes place in this zone. To take advantage of the resulting improvement in the textile properties of the monofilaments, the distance between the draw-off unit and the zone of natural yarn deflection is preferably selected to be sufficiently great to subject the monofilament to post-drawing.

Although, as already mentioned, it is not possible in the zone of natural yarn deflection to deflect the monofilaments mechanically, i.e., by means of a deflecting element, it has surprisingly been possible to shift this zone of natural yarn deflection nearer the spinneret by installing a baffle plate vertically below the spinneret. This process variant is preferred because it allows further reduction of the spinning height (up to one meter).

To improve the properties of the monofilaments, it is, furthermore, expedient to displace the zone of natural yarn deflection in a cooling liquid, e.g., in a water trough, which can be used instead of the mentioned baffle plate.

Inasmuch as required by desirable monofilament properties, one may provide behind the draw-off unit, e.g., a set of godets, an additional drawing zone. Other aftertreatments, e.g., relaxation, setting and the like, can also be applied before winding of the monofilaments.

Finally, it is also possible to effect post-drawing of the monofilaments by providing thread guiding elements between the zone of natural yarn deflection and the draw-off unit.

The process of the invention, with its many variants, expecially that involving the phenomenon of natural yarn deflection, can be used for the production of high speed spun monofilaments from practically any conventional melt-spinnable polymer. Because of their special use properties, mention is particularly made of polyamides, specifically polycaprolactam and polyhexamethylene adipamide; polyesters, specifically polyethylene terephtalate; polyolefins, specifically polyethylene and polypropylene; polyvinylchloride.

End-use fields for the monofilaments according to the invention, include fish nets, fishing lines, filter fabrics, synthetic bristles for brushes and for upholstering, strings for tennis rackets, strings for musical instruments, synthetic hair and reinforcing material.

BRIEF DESCRIPTION OF THE DRAWINGS

The invention is explained on hand of enclosed drawing, wherein.

DETAILED DESCRIPTION OF THE INVENTION

Figure 1:
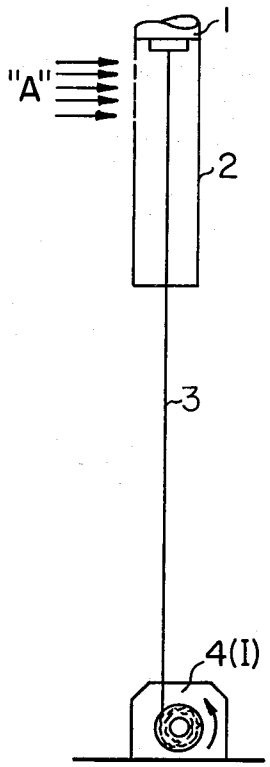
FIG. 1 is a schematic of a high-speed spinning unit with draw-off unit located vertically below the spinneret.

As shown in FIG. 1, melt is spun from spinneret 1 into a chimney 2, the upper portion of which may be equipped with a blowing system "A". After drawing/-stretching, solidification and adequate cooling, the freshly spun monofilament 3 is taken up by a draw-off unit, here a winding unit 4, which, in its base position (I), is located vertically below spinneret 1. Thereby, monofilament 3—except for minor deviations due to blowing "A"—travels from spinneret 1 vertically down towards winding unit 4.

Figure 2:
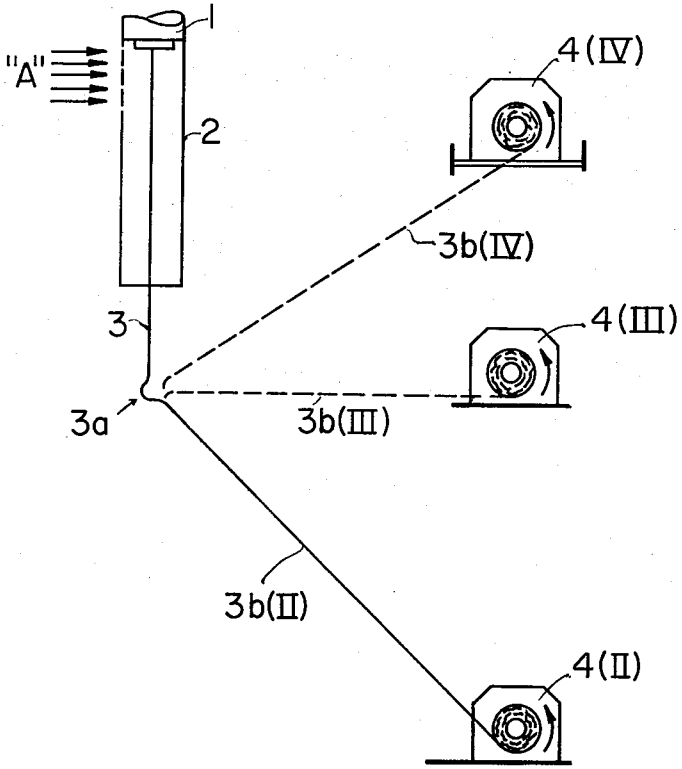
FIG. 2 is a schematic of the installation with laterally displaced draw-off unit (mounted at different heights)

To visualize the "phenomenon of natural yarn deflection" to be utilized according to the invention, winding unit 4 is shifted laterally from base position (I), FIG. 1, to position (II), cf, FIG. 2. Monofilament 3 is displaced not—as might have been expected—in a parabolic or similar curve, suspended freely from spinneret 1 to winding unit 4, but initially moves—as if the winding unit were in base position (I)—vertically downward. Then one observes a zone 3*a* in which the monofilament is deflected laterally (at first, away from winding unit 4) and subsequently describing an arc, follows a path leading practically straight to winding unit 4. This monofilament segment is identified as 3*b*, whereby adjunct (II) is related to position (II) of winding unit 4.

Figure 3:
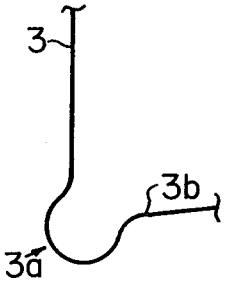
FIG. 3 is an enlarged segment of a freshly spun monofilament in the zone of natural yarn deflection.

If one now raises winding unit 4, Position (III) and (IV) there is with otherwise constant spinning conditions practically no change in the location of zone 3*a*. Merely the shape of the deflection, shown enlarged in FIG. 3, is somewhat modified due to the reduction of the angle between 3*b* and 3, resulting from shifting the height of winding unit 4 from position (II) via (III) to (IV).

In the illustrated example, the spinning height, i.e., the (vertical) distance between spinneret 1 and winding unit 4 can be distinctly reduced, whereby the height of the spinning room may be simultaneously reduced to the distance between spinneret and zone 3*a*.

The monofilament need not travel directly from zone 3*a* to the draw-off unit. Rather—once the monofilament has sufficiently cooled—conventional thread guiding elements (thread guides, finish rolls) or drawing units may precede the draw-off unit (not shown).

Figure 5:
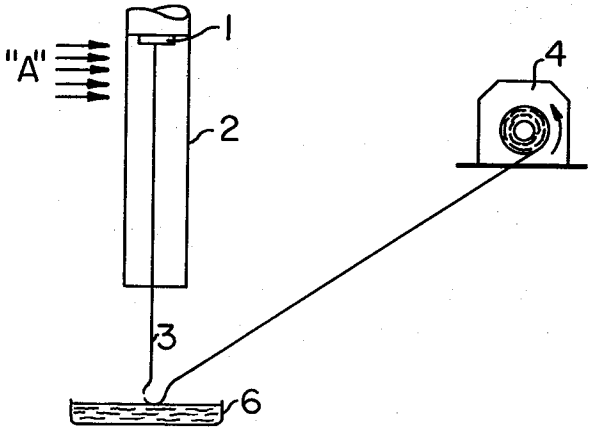
FIG. 5 is a schematic depiction of the invention showing the use of a water trough vertically below the spinneret.
Figure 4:
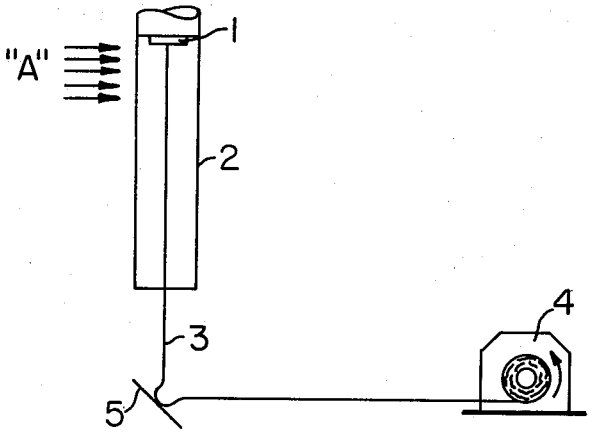
FIG. 4 is a schematic view of the invention depicting a baffle plate located vertically below the spinneret.

When, in a layout as shown in FIG. 4, a baffle plate 5 aligned below zone 3*a* perpendicularly or at an angle to the travel path of monofilament 3 is carefully displaced towards zone 3*a* of the monofilament and further lifted, it is possible—while preserving a stable yarn travel—to raise zone 3*a* of the natural yarn deflection by as much as about 1 meter. The use of a water trough 6 below the spinneret 1 is depicted in FIG. 5 wherein the height of the spinning column can be further reduced.

EXAMPLE

Polyethylene terephthalate of a chips solution viscosity of 1.63 is spun at a temperature of 280° C. from a single orifice spinneret (orifice diameter 2 mm.). Throughput of the polymer through the orifice is 55 g/min.

The freshly spun monofilament drops vertically through a blowing chimney (blowing air 250 m/hr). At a horizontal distance of about 5 m and a vertical distance of about 9.5 m from the spinneret, a winding unit is installed with a thread guide mounted some 1.2 m above said winding unit. The monofilament which at first is spun perpendicularly on the floor of the winding room, is fed by means of an injector via the thread guide to the winding unit running at a winding speed of 5800 mpm. The monofilament then drops perpendicularly from a height of about 9 meters downward, is deflected upward as shown in FIG. 3 at an angle of less than 90° and travels over the thread guide to the traverse system of the winding unit.

The finished monofilaments have a denier of about 96 dtex, a breaking elongation of 48%, and a strength of 32.7 cN/tex.

What we claim is:

1. A process for manufacturing a monofilament yarn selected from the group of synthetic polymers consisting of polyamides, polyesters and polyolefins, comprising the steps of melt spinning a polymer substantially vertically downward into a cooling gaseous atmosphere to form a monofilament, inducing a natural yarn deflection into the downward path of the monofilament and thereafter drawing the monofilament to a winding device laterally displaced from the spinning point at a speed of at least 2,750 meters per minute.

2. The process of claim 1, wherein the gaseous atmosphere is moving transversely across the monofilaments.

3. The process of claim 1, wherein the monofilament is drawn to said winding device at a speed between 5000 and 7000 meters per minute.

4. The process of claim 3, where the monofilament is drawn to said winding device at a speed between about 5200 and 6000 meters per minute.

5. The process of claim 3 or 4, wherein the monofilament is deflected from its downward path while the monofilament temperature is above about 150° C. and the monofilament degree of crystallization is less than 10%.

6. The process of claim 1, including shifting the point of deflection upward by inserting a baffle under the deflection point and moving the baffle upward.

7. The process of claim 6, wherein the baffle comprises a trough of cooling liquid.

8. The process of claim 3, further including the steps of additionally drawing the monofilament after the point of deflection and prior to winding said monofilament.

* * * * *